US006981710B2

(12) United States Patent
Cheng

(10) Patent No.: US 6,981,710 B2
(45) Date of Patent: Jan. 3, 2006

(54) WHEEL ASSEMBLY FOR SKATEBOARD

(76) Inventor: Sheng-Huan Cheng, No. 481-11, Lane 477, Chung-Cheng Rd., Lu-Chou City, Taipei Hsien (TW)

( * ) Notice: Subject to any disclaimer, the term of this patent is extended or adjusted under 35 U.S.C. 154(b) by 174 days.

(21) Appl. No.: 10/738,859

(22) Filed: Dec. 16, 2003

(65) Prior Publication Data

US 2005/0093253 A1 May 5, 2005

(51) Int. Cl.
*A63C 17/02* (2006.01)

(52) U.S. Cl. ..... 280/87.03; 280/87.042; 280/11.28

(58) Field of Classification Search ..... 280/87.041, 280/87.42, 87.03, 11.27, 11.28
See application file for complete search history.

(56) References Cited

U.S. PATENT DOCUMENTS 2,330,147 A * 9/1943 Rodriguez ..... 280/87.041
5,263,725 A * 11/1993 Gesmer et al. ..... 280/11.28
6,286,843 B1 * 9/2001 Lin ..... 280/11.28
6,398,238 B1 * 6/2002 Shaw ..... 280/87.042
6,616,155 B2 * 9/2003 Tuan ..... 280/87.041
6,793,224 B2 * 9/2004 Stratton ..... 280/87.042
6,913,272 B2 * 7/2005 Chang ..... 280/87.042

* cited by examiner

*Primary Examiner*—Jeff Restifo
(74) *Attorney, Agent, or Firm*—Merchant & Gould P.C.

(57) ABSTRACT

A wheel assembly for a skateboard includes a positioning seat, a wheel set and an adjustment seat mounted respectively on bottom and top sides of the positioning seat, a positioning post, and a pair of opposite resilient plates, each having fixed and abutting ends. The adjustment seat includes first and second portions, and a receiving space. The first portion and the positioning seat are interconnected pivotally so as to permit relative movement between the positioning and adjustment seats. The positioning post extends into the receiving space. The resilient plates are disposed in the receiving space on opposite sides of the positioning post. The abutting ends of the resilient plates abut against the positioning post.

10 Claims, 7 Drawing Sheets

WHEEL ASSEMBLY FOR SKATEBOARD

BACKGROUND OF THE INVENTION

1. Field of the Invention

The invention relates to a wheel assembly, more particularly to a wheel assembly for a skateboard.

2. Description of the Related Art

Referring to FIGS. 1 and 2, a conventional skateboard 7 includes a footboard 8 and a wheel assembly 9 fixed on a bottom side of the footboard 8. The wheel assembly 9 includes a positioning seat 91, a wheel set 92 mounted below the positioning seat 91, and an adjustment seat 93 mounted pivotally on the positioning seat 91 through a shaft 94 and disposed below the footboard 8. When the center of gravity of a skater changes from left to right or right to left during use of the skateboard 7, the positioning seat 91 and the wheel set 92 rotate about the shaft 94 relative to the adjustment seat 93 so as to turn the footboard 8. Then, through coordination of a screw rod 96, an L-shaped plate 97, a packing ring 98, and a coil spring 99, which are all mounted in a receiving space 95 of the adjustment seat 93, with a circular rod 90 that is fixed on the positioning seat 91 and that extends through an opening 951 in the adjustment seat 93, the foot board 8 is restored to its original state.

However, during mounting of the screw rod 96, the L-shaped plate 97, the packing ring 98, and the coil spring 99 in the receiving space 95 of the adjustment seat 93, it is necessary that the coil spring 99 and the packing ring 98 be placed first in the receiving space 95. Then, the L-shaped plate 97 is placed in the receiving space 95 so as to cover the coil spring 99 and the packing ring 98 and to cause the circular rod 90 to extend through a hole 971 in the L-shaped plate 97. Afterwards, the screw rod 96 is passed through a hole 931 in the adjustment seat 93, through another hole 972 in the L-shaped plate 97, and through the coil spring 99 so as to engage threadedly a screw end 961 of the screw rod 96 with a screw hole 981 in the packing ring 98. Assembly, as such, is difficult since the screw rod 96 has to be threaded through the holes 931 and 972 and inserted into the coil spring 99 after the coil spring 99 and the packing ring 98 are covered by the L-shaped plate 97. Moreover, the coil spring 99 is different from an ordinary spring because the coil spring 99 must be stiff enough to provide a high restoring force such that the cost of producing the skateboard 7 is increased.

SUMMARY OF THE INVENTION

Therefore, the object of the present invention is to provide a wheel assembly for a skateboard that is easy to assemble and that is relatively inexpensive.

According to this invention, a wheel assembly for a skateboard comprises a positioning seat, a wheel set, an adjustment seat, a positioning post, and a pair of opposite resilient plates. The wheel set is mounted on the bottom side of the positioning seat. The adjustment seat is mounted on the top side of the positioning seat, and includes a first portion, a second portion opposite to the first portion, and a receiving space. The first portion and the positioning seat are interconnected pivotally so as to permit relative movement between the positioning seat and the adjustment seat. The positioning post is mounted on the positioning seat, and extends into the receiving space. The resilient plates are positioned on the adjustment seat within the receiving space, and are disposed on opposite sides of the positioning post. Each of the resilient plates has a fixed end disposed proximate to the second portion, and an abutting end opposite to the fixed end. The abutting ends of the resilient plates abut against the positioning post.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 3:
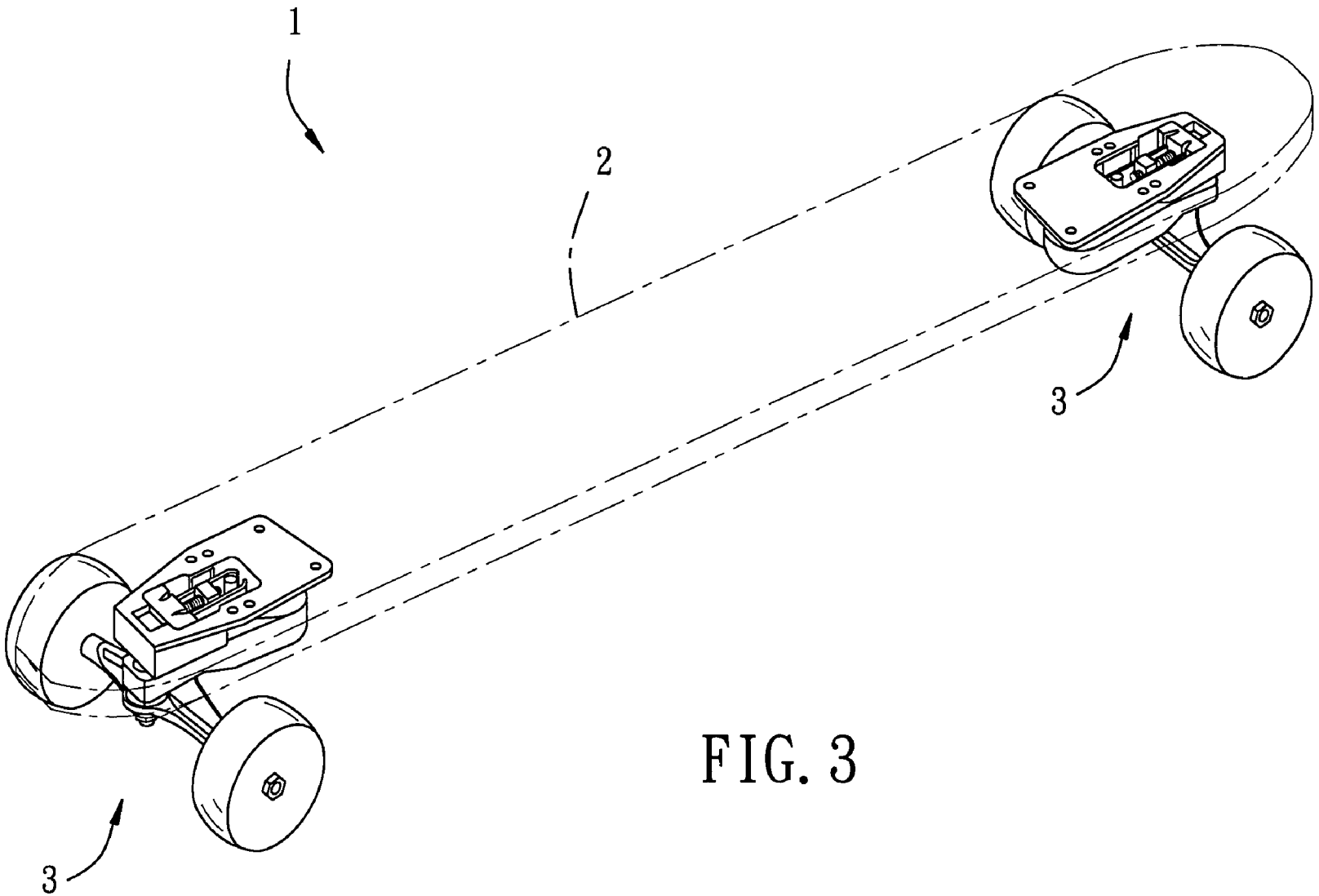
FIG. 3 is a perspective view of a skateboard incorporating the preferred embodiment of a wheel assembly of the present invention.
Figure 4:
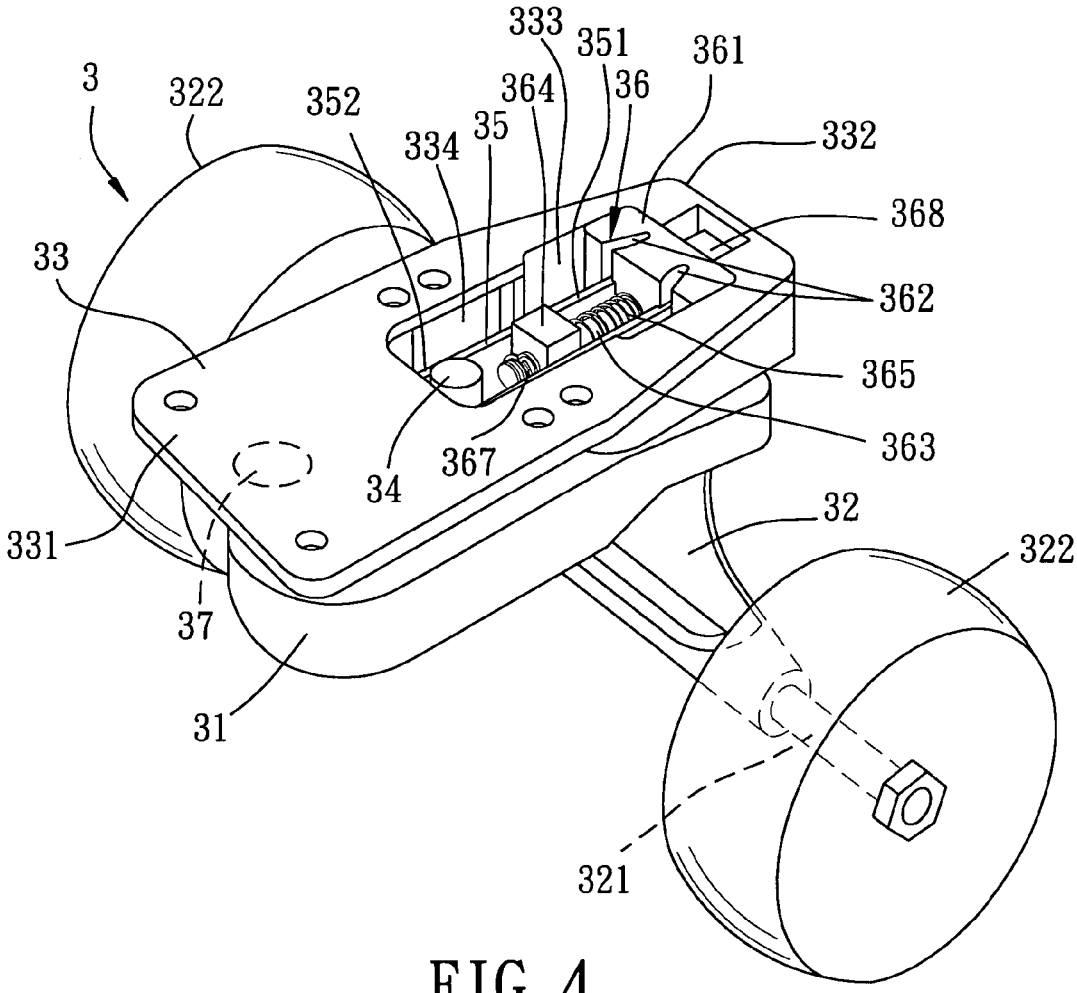
FIG. 4 is an enlarged perspective view of the preferred embodiment.
Figure 5:
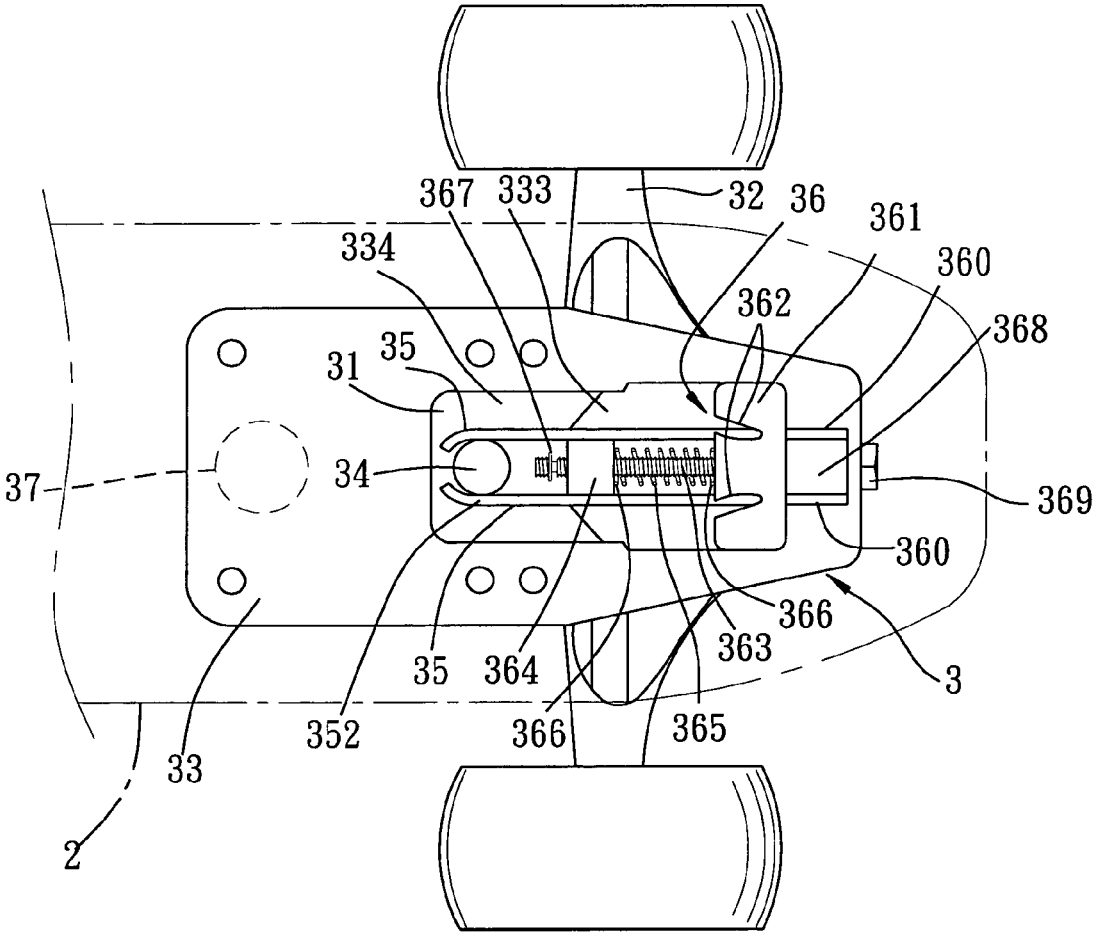
FIG. 5 is a schematic top view of the preferred embodiment.

Referring to FIGS. 3 to 5, the preferred embodiment of a wheel assembly 3 according to the present invention is shown to be mounted on each of the front and rear ends of a footboard 2 of a skateboard 1 in opposite directions. Each of the front and rear ends of the footboard 2 is assembled with the wheel assembly 3 in this embodiment. However, when the front and rear ends of the footboard 2 are turnable, the turning directions of the front and rear ends should be opposite. Therefore, if the wheel assembly 3 is disposed only on the front end, the rear end can be assembled with an ordinary wheel assembly that does not function to control the direction of the footboard 2.

The wheel assembly 3 of the present invention comprises a positioning seat 31, a wheel set 32, an adjustment seat 33, a positioning post 34, a pair of resilient plates 35, and a resiliency adjustment device 36.

The wheel set 32 is mounted fixedly on the bottom side of the positioning seat 31 in a conventional manner, and includes a wheel axle 321 and two roller wheels 322 journalled to the wheel axle 321.

The adjustment seat 33 is mounted on the top side of the positioning seat 31, and is fixed on a bottom surface of the footboard 2 in a conventional manner. The adjustment seat 33 includes a first portion 331, a second portion 332 opposite to the first portion 331, and a receiving space 333. The receiving space 333 extends from the second portion 332 toward the first portion 331, and has an opening 334 at the top side of the adjustment seat 33. The first portion 331 and the positioning seat 31 are interconnected pivotally through a spindle 37 (see FIG. 4) so that the positioning seat 31 and the adjustment seat 33 can move relative to each other.

The positioning post 34 is mounted fixedly on the top side of the positioning seat 31, and extends into the receiving space 333 in the adjustment seat 33.

The resilient plates 35 are positioned on the adjustment seat 33 within the receiving space 333, and are disposed on opposite sides of the positioning post 34. Each of the resilient plates 35 has a fixed end 351 proximate to the second portion 332, and an abutting end 352 opposite to the fixed end 351. The abutting ends 352 of the resilient plates 35 are curved ends that abut against the positioning post 34.

The resiliency adjustment device 36 is mounted on the adjustment seat 33, and includes an adjustable piece 361, a screw rod 363, a first vertical post 364, a spring member 365, a C-shaped ring 367, and a second vertical post 368.

The adjustable piece 361 is mounted slidably on the resilient plates 35 between the fixed ends 351 and the abutting ends 352, and is formed with two non-parallel grooves 362 for insertion of the resilient plates 35 respectively therethrough. The grooves 362 extend upwardly from a bottom surface of the adjustable piece 361. When the adjustable piece 361 is moved toward or away from the fixed ends 351 of the resilient plates 35, the effective length of the resilient plates 35 can be changed so that resiliency of the latter is adjusted. When the adjustable piece 361 is moved away from the fixed ends 351, that is, proximate to the positioning post 34, the resilient plates 35 are placed closer to the positioning post 34.

The screw rod 363 extends into the receiving space 333 through the second portion 332 of the adjustment seat 33, and is located between the resilient plates 35. The screw rod 363 extends threadedly through the adjustable piece 361 so as to permit adjusting of the latter. One end of the screw rod 363, which is located externally of the second portion 332 of the adjustment seat 33, is provided with an adjustment knob 369 for rotating the screw rod 363.

The first vertical post 364 is mounted fixedly within the receiving space 333 in the adjustment seat 33, is sleeved on the screw rod 363, and is located between the adjustable piece 361 and the positioning post 34.

The spring member 365 is sleeved on the screw rod 363, and has two ends 366 (see FIG. 5) abutting respectively against the adjustable piece 361 and the first vertical post 364.

The C-shaped ring 367 is sleeved on the other end of the screw rod 363, which is located proximate to the positioning post 34, so as to clamp the screw rod 363. The screw rod 363 is therefore limited and prevented from being released from the first vertical post 364.

The second vertical post 368 is sleeved on the screw rod 363 opposite to the first vertical post 364. The second vertical post 368 and the second portion 332 of the adjustment seat 33 cooperate to define two clamp holes 360 (see FIG. 5) for receiving the fixed ends 351 of the resilient plates 35, thereby positioning the fixed ends 351 on the adjustable seat 33.

When a skater on the footboard 2 is in a balanced state, the positioning seat 31 is aligned with the adjustment seat 33, and will not rotate about the spindle 37, as illustrated in FIG. 5.

Figure 6:
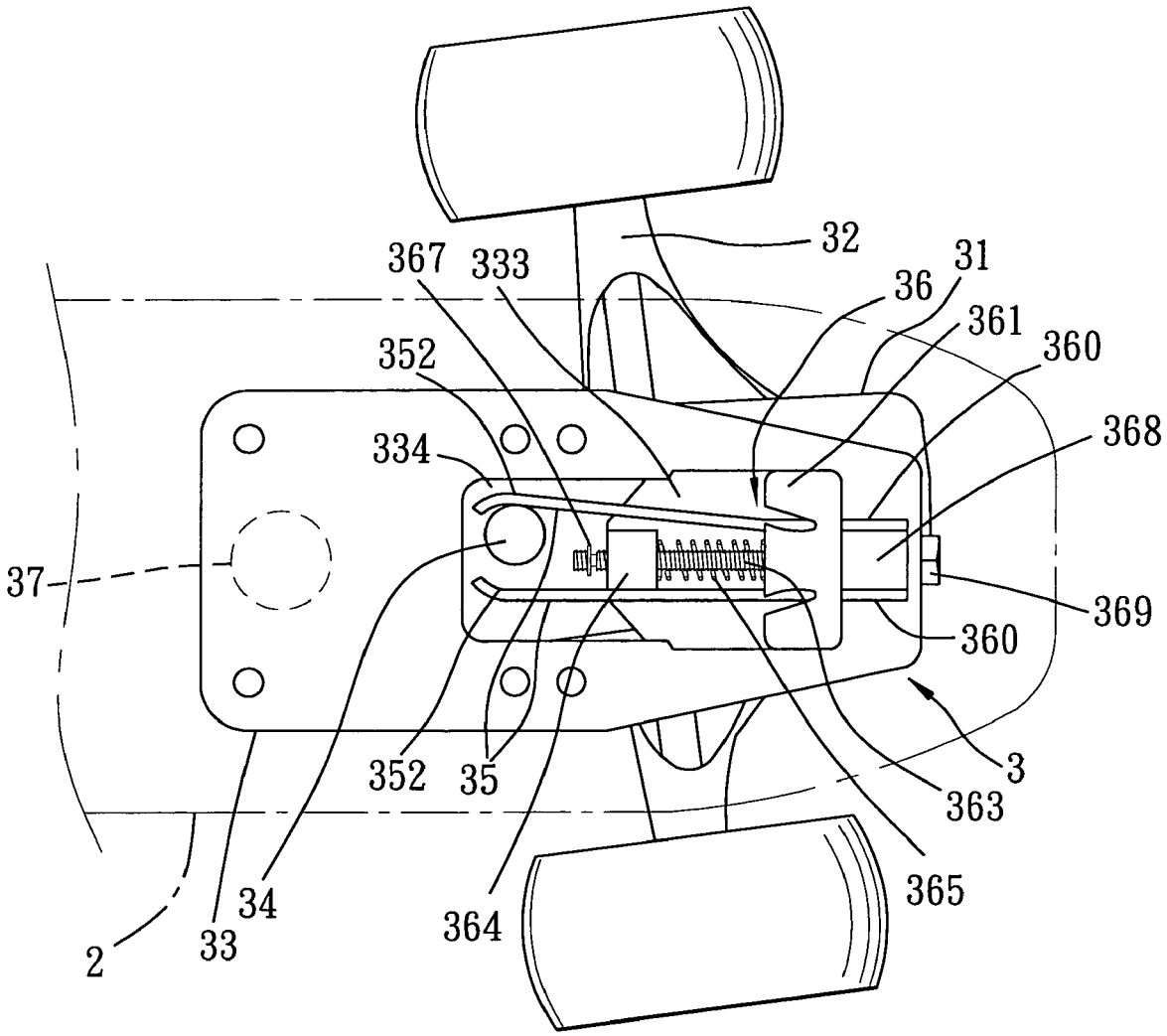
FIG. 6 is a view substantially similar to FIG. 5, but with a wheel set and a positioning seat turned relative to an adjustment seat.

When the center of gravity of the skater changes to the left or right, the positioning seat 31, along with the wheel set 32 and the positioning post 34, pivot about the spindle 37 relative to the adjustment seat 33 to a state shown in FIG. 6. At this time, the abutting end 352 of one of the resilient plates 35 is pushed by the positioning post 34 so as to store a force that will restore the positioning seat 31, the wheel set 32, and the positioning post 34 to their original states shown in FIG. 5.

Through the adjustable piece 361, the screw rod 363, the first vertical post 364, the spring member 365, the C-shaped ring 367, and the second vertical post 368 of the resiliency adjustment device 36, the resiliency of the resilient plates 35 on the positioning post 34 can be adjusted, thereby adjusting the restoring force of the resilient plates 35. The resilient plates 35 are shown in FIG. 5 to be in a loosened state. At this time, the adjustable piece 361 is located at the leftmost end and abuts against the second vertical post 368 so that the effective length of the resilient plates 35 is longest and the resiliency, hence the restoring force, of the resilient plates 35 is smallest.

Figure 7:
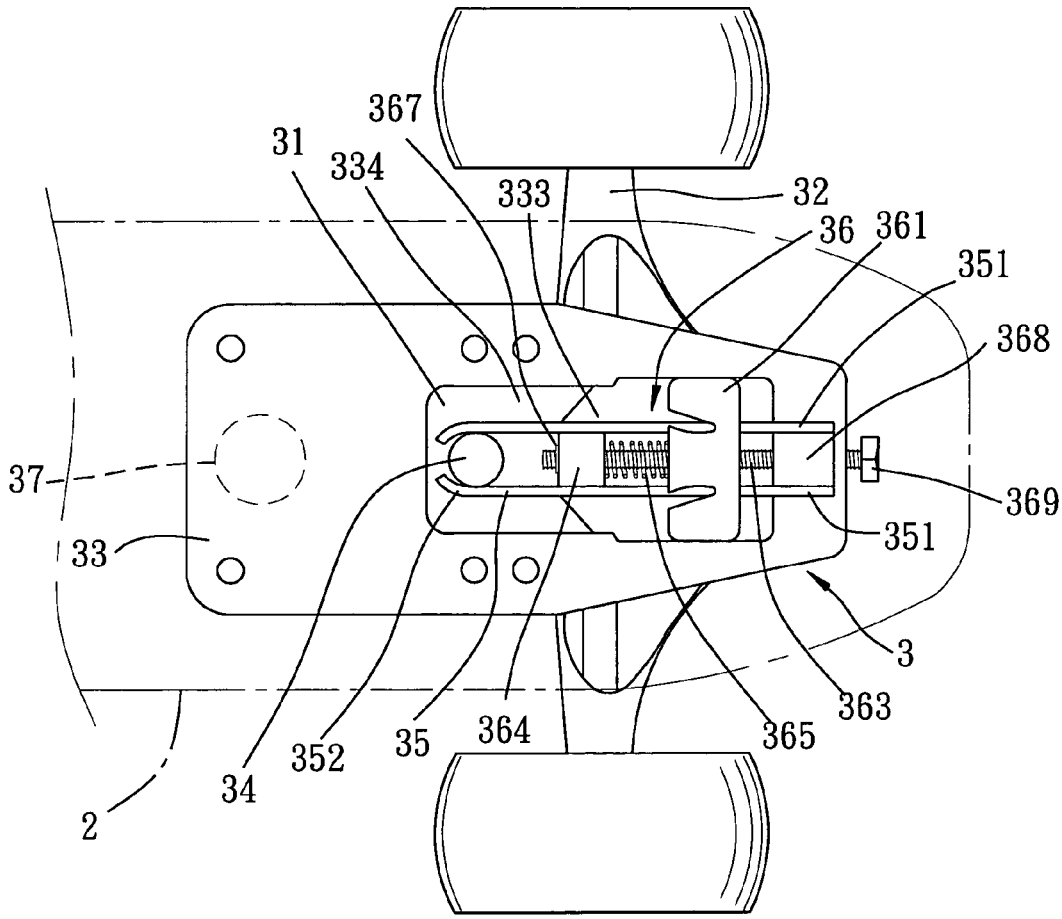
FIG. 7 is a view substantially similar to FIG. 5, but with an adjustable piece operated to adjust the restoring force of resilient plates.

Referring to FIG. 7, when the adjustment knob 369 is rotated so as to rotate the screw rod 363, the adjustable piece 361 moves simultaneously away from the fixed ends 351 of the resilient plates 35 and compresses slowly the spring member 365 so that the abutting ends of the resilient plates 35 abut tightly against the positioning post 34. In this situation, the effective length of the resilient plates 35 is shortened and the restoring force is increased.

As mentioned hereinabove, the wheel assembly 3 of the present invention not only provides the footboard 2 with a restoring force, but also permits adjustment of the restoring force as desired.

Figure 1:
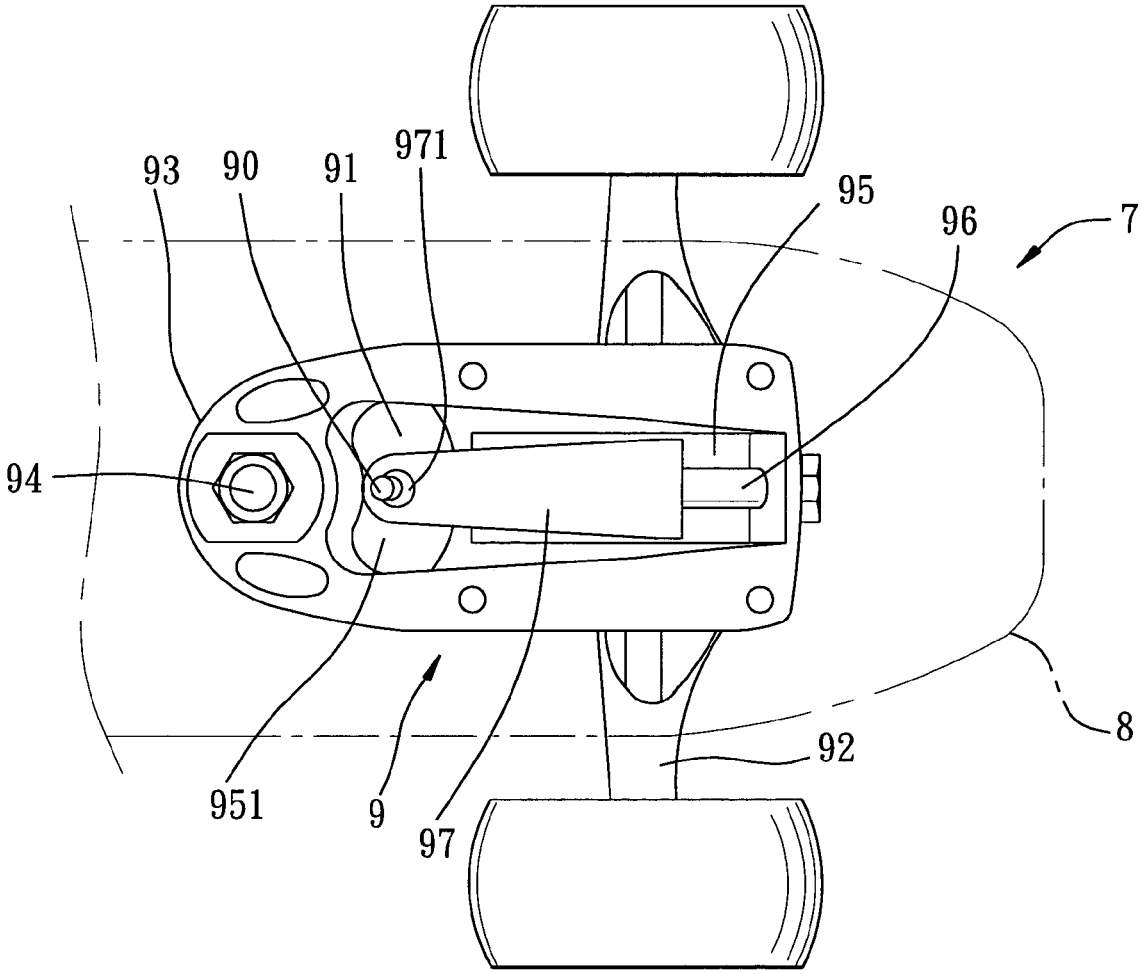
FIG. 1 PRIOR ART
FIG. 1 is a fragmentary schematic view of a conventional skateboard.
Figure 2:
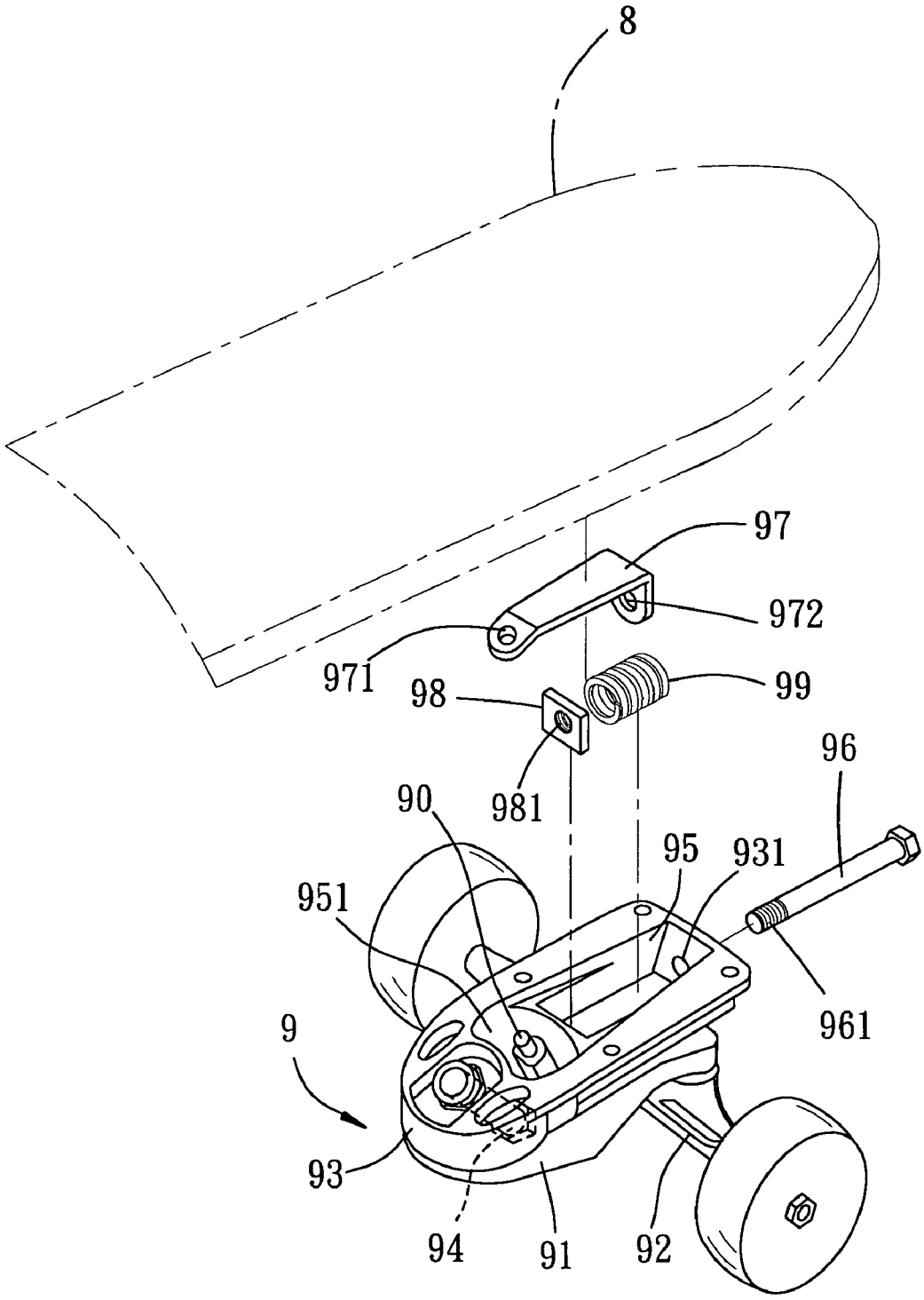
FIG. 2 PRIOR ART
FIG. 2 is a partly exploded perspective view of a wheel assembly of the conventional skateboard.

From the aforementioned description of the preferred embodiment, since the adjustment seat 33 is mounted pivotally on the positioning seat 31, and since the positioning post 34 and the resilient plates 35 abut against each other and are fixed respectively on the positioning seat 31 and the adjustment seat 33, when the positioning seat 31 and the adjustment seat 33 pivot relative to each other, the positioning post 34 pushes one of the resilient plates 35 so that the resilient plate 35 can store a force that will restore the positioning seat 31 and the adjustment seat 33 to their original positions. Furthermore, the degree of the restoring force can be adjusted as desired. Moreover, since the L-shaped plate 97 (see FIG. 2) of the conventional wheel assembly is dispensed herewith, assembly of the wheel assembly 3 of the present invention is easier to conduct. Additionally, the cost of the resilient plates 35 is lower than that of the coil spring 99 (see FIG. 2).

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A wheel assembly for a skateboard, comprising:

a positioning seat having a top side and a bottom side;

a wheel set mounted on the bottom side of said positioning seat;

an adjustment seat mounted on the top side of said positioning seat, said adjustment seat including a first portion, a second portion opposite to said first portion, and a receiving space, said first portion and said positioning seat being interconnected pivotally so as to permit relative movement between said positioning seat and said adjustment seat;

a positioning post mounted on said positioning seat and extending into said receiving space; and a pair of opposite resilient plates positioned on said adjustment seat within said receiving space and disposed on opposite sides of said positioning post, each of said resilient plates having a fixed end disposed proximate to said second portion, and an abutting end opposite to said fixed end, said abutting ends of said resilient plates abutting against said positioning post.

2. The wheel assembly as claimed in claim 1, further comprising a resiliency adjustment device mounted on said adjustment seat for adjusting resiliency of said resilient plates.

3. The wheel assembly as claimed in claim 2, wherein said resiliency adjustment device includes an adjustable piece mounted slidably on said resilient plates between said fixed ends and said abutting ends, said adjustable piece being formed with two grooves for inserting said resilient plates respectively therethrough, said adjustable piece being movable toward and away from said fixed ends so as to adjust resiliency of said resilient plates.

4. The wheel assembly as claimed in claim 3, wherein said resiliency adjustment device further includes a screw rod extending into said receiving space through said second portion of said adjustment seat and located between said resilient plates, said screw rod extending threadedly through said adjustable piece so as to permit adjusting of said adjustable piece.

5. The wheel assembly as claimed in claim 4, wherein said screw rod has one end located externally of said second portion of said adjustment seat, said one end being provided with an adjustment knob for rotating said screw rod.

6. The wheel assembly as claimed in claim 4, wherein said resiliency adjustment device further includes a first vertical post that is mounted within said receiving space, that is sleeved on said screw rod, and that is located between said adjustable piece and said positioning post, and a spring member sleeved on said screw rod and having two ends abutting respectively against said adjustable piece and said first vertical post.

7. The wheel assembly as claimed in claim 6, wherein said resiliency adjustment device further includes a C-shaped ring sleeved on said screw rod so as to clamp said screw rod.

8. The wheel assembly as claimed in claim 6, wherein said resiliency adjustment device further includes a second vertical post sleeved on said screw rod opposite to said first vertical post, said second vertical post cooperating with said second portion of said adjustment seat to fix said fixed ends of said resilient plates on said adjustment seat.

9. The wheel assembly as claimed in claim 1, further comprising a spindle for connecting pivotally said first portion of said adjustment seat to said positioning seat.

10. The wheel assembly as claimed in claim 1, wherein said abutting ends of said resilient plates are curved ends.

* * * * *